US012247503B2

(12) United States Patent
Gordon

(10) Patent No.: US 12,247,503 B2
(45) Date of Patent: Mar. 11, 2025

(54) ENGINE OIL STARVATION PREVENTER

(71) Applicant: Robby Gordon, Charlotte, NC (US)

(72) Inventor: Robby Gordon, Charlotte, NC (US)

( * ) Notice: Subject to any disclaimer, the term of this patent is extended or adjusted under 35 U.S.C. 154(b) by 0 days.

(21) Appl. No.: 18/313,800

(22) Filed: May 8, 2023

(65) Prior Publication Data

US 2023/0358152 A1 Nov. 9, 2023

Related U.S. Application Data

(60) Provisional application No. 63/339,359, filed on May 6, 2022.

(51) Int. Cl.
*F01M 11/06* (2006.01)
*F01M 11/00* (2006.01)
*F01M 11/04* (2006.01)

(52) U.S. Cl.
CPC ... *F01M 11/067* (2013.01); *F01M 2011/0041* (2013.01); *F01M 11/0408* (2013.01)

(58) Field of Classification Search
CPC .. F16H 57/0443; F01M 11/06; F01M 11/061; F01M 11/062; F01M 11/064; F01M 11/065; F01M 11/067
See application file for complete search history.

(56) References Cited

U.S. PATENT DOCUMENTS 1,705,845 A * 3/1929 Woodman ..... F16N 19/006 137/453
1,753,718 A * 4/1930 Paxton ..... F01M 11/061 261/DIG. 35
2,946,328 A * 7/1960 Mettetal, Jr. ..... F01M 11/061 123/196 R
3,458,011 A * 7/1969 Dwyer ..... F04B 39/02 184/6
3,712,420 A * 1/1973 Pelizzoni ..... F01M 11/061 244/39
4,301,824 A * 11/1981 Payne ..... G05D 9/02 137/391
4,346,786 A * 8/1982 Midgley ..... F01M 11/067 184/6.4
6,463,819 B1 * 10/2002 Rago ..... F01M 11/067 137/115.26
8,985,278 B2 * 3/2015 Xu ..... F01D 25/20 184/6.11

(Continued)

*Primary Examiner* — Minh Truong
(74) *Attorney, Agent, or Firm* — Barry Choobin; Patent 360

(57) ABSTRACT

An apparatus and methods for the lubrication of the engine of an off-road vehicle, such as when the vehicle is airborne or upside down due to tipping over. The apparatus includes an upper chamber and a lower chamber. Fluid communication is established between the upper chamber and the lower chamber by way of a central tube. One or more vanes are arranged in the interior of the central tube to inhibit oil flow from the lower chamber to the upper chamber when the vehicle is upside down. An inlet hose connector is configured for receiving engine oil from an oil cooler and supplying the engine oil to the lower chamber. An outlet hose connector is configured for conducting the engine oil from the lower chamber to the engine. A bypass hose connector is configured for allowing the engine oil to exit from the upper chamber to the engine.

12 Claims, 4 Drawing Sheets

(56) References Cited

U.S. PATENT DOCUMENTS

2011/0303677 A1* 12/2011 Heppner ..... F01M 11/0004
123/196 R
2014/0026988 A1* 1/2014 Peterson ..... F16H 57/0447
137/544

* cited by examiner

FIG. 1
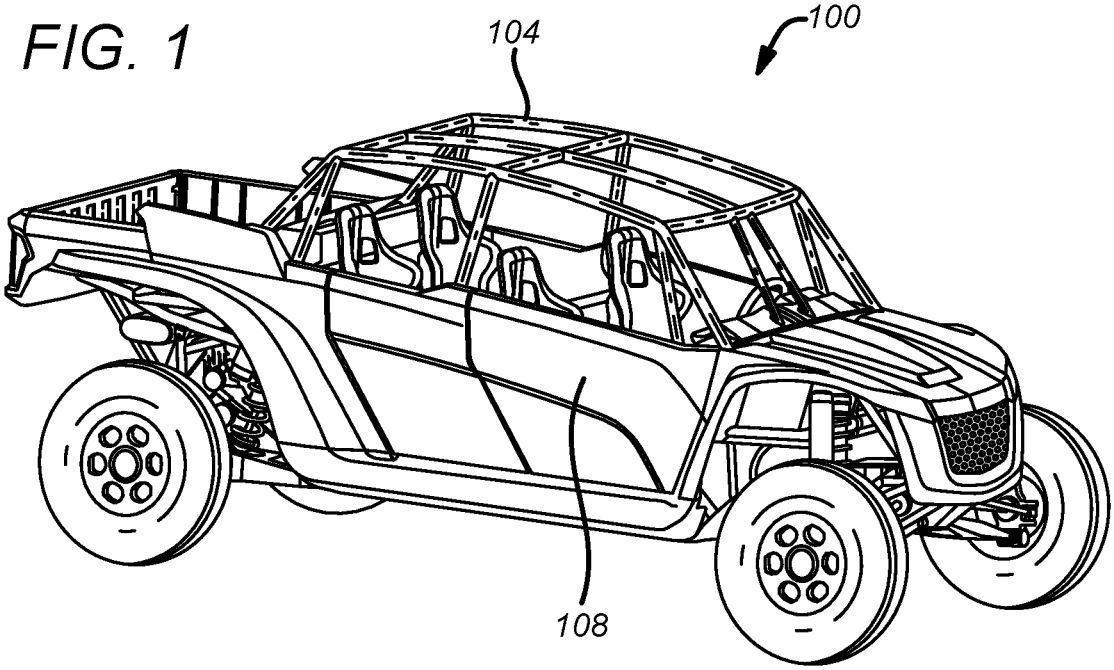
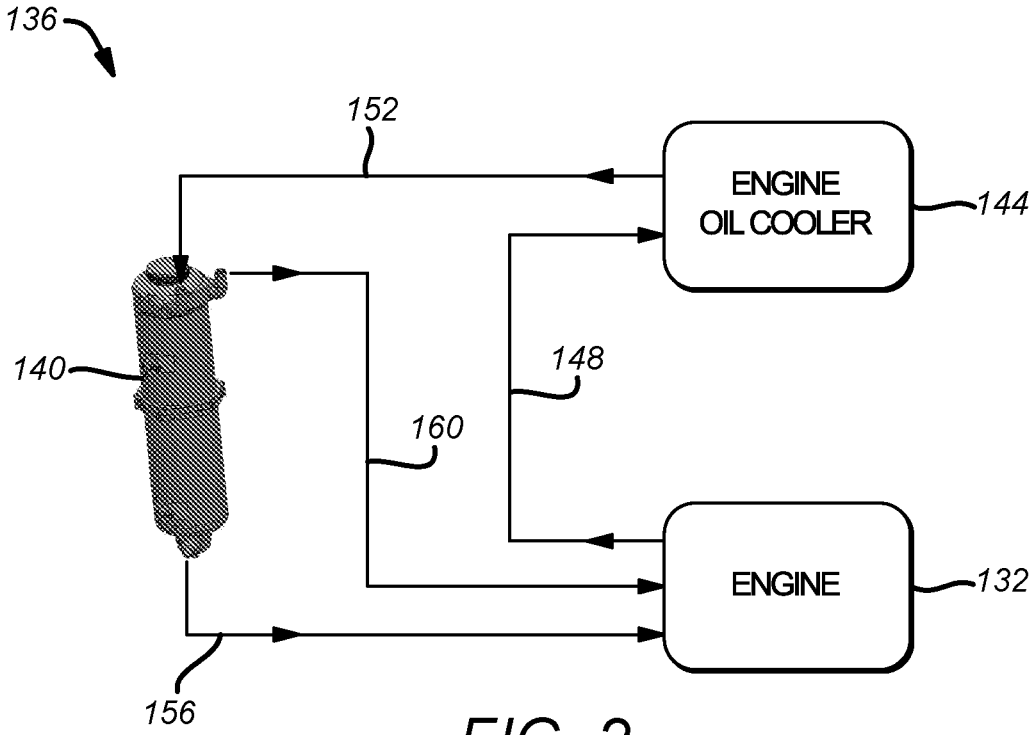
FIG. 2

ENGINE OIL STARVATION PREVENTER

CROSS-REFERENCE TO RELATED APPLICATIONS

This application claims priority from a U.S. Provisional Patent Application Ser. No. 63/339,359, filed on May 6, 2022, the disclosure of which is incorporated herein by reference in their entirety.

FIELD OF INVENTION

The present invention relates to an engine oil circulation system, and more specifically, the present invention relates to an apparatus and methods for maintaining lubrication to an engine of an off-road vehicle.

BACKGROUND

Off-road vehicles enjoy an enthusiastic following because of their many uses and versatility. As a result, several types of motorsports involve the racing of various types of off-road vehicles. For example, competitions exist that are dedicated to various types of terrain, such as rallies, desert racing, and rock crawling.

During such competitions, off-road vehicles may perform stunts and routinely become airborne (e.g., perform jumps) due to terrain features.

A difficulty often encountered during racing off-road vehicles is that the engines can become oil starved during jumping or tip-over events. As will be appreciated, during normal operation of an engine, an oil pump draws engine oil from a sump at the bottom of the engine and pumps the oil to various working components of the engine. When an off-road vehicle is airborne or upside down, the oil no longer remains pooled at the bottom of the sump, causing the oil pump to run out of oil to pump. Thus, the engine can be left running, often at high rpm, without sufficient lubrication to prevent damage to the working components of the engine. Given that running an engine without oil, even momentarily at low speeds, can cause severe engine damage and lead to costly, time-consuming repairs, there is a desire to prevent engine oil starvation and to maintain sufficient lubrication to various components of the engine during airborne maneuvers and tip over events.

SUMMARY OF THE INVENTION

The following presents a simplified summary of one or more embodiments of the present invention to provide a basic understanding of such embodiments. This summary is not an extensive overview of all contemplated embodiments and is intended to neither identify critical elements of all embodiments nor delineate the scope of any or all embodiments. Its sole purpose is to present some concepts of one or more embodiments in a simplified form as a prelude to the more detailed description that is presented later.

The principal object of the present invention is therefore directed to an apparatus for an off-road vehicle that keeps the engine lubricated when the vehicle becomes airborne or upside down due to tipping over.

In one aspect, an apparatus and a method of use thereof are disclosed for an off-road vehicle that maintains lubrication to an engine during a bumpy ride, such as when the vehicle is airborne or upside down due to tipping over. The apparatus includes an upper chamber and a lower chamber. A central tube fluidly connects the upper chamber and the lower chamber. One or more vanes are arranged in the interior of the central tube to inhibit oil flow from the lower chamber to the upper chamber when the vehicle is upside down. An inlet hose connector is configured for receiving engine oil from an oil cooler and supplying the engine oil to the lower chamber. An outlet hose connector is configured for conducting the engine oil from the lower chamber to the engine. A bypass hose connector is configured for allowing the engine oil to exit the upper chamber and into the engine.

In an exemplary embodiment, disclosed is an apparatus that includes an upper chamber and a lower chamber; a separator disposed between the upper chamber and the lower chamber; an inlet hose connector for supplying engine oil to the lower chamber; an outlet hose connector for conducting the engine oil from the lower chamber to an engine; and a bypass hose connector for allowing engine oil to exit the upper chamber and into the engine.

In another exemplary embodiment, the disclosed apparatus further includes a fill chamber atop the upper chamber; a base at the bottom of the lower chamber; and a central tube extending from the base, through the separator, and opening into the fill chamber.

In another exemplary embodiment, a fill cap is disposed atop the fill chamber for adding engine oil and removing trapped air within the upper chamber. In another exemplary embodiment, a drain plug is threaded into the bottom of the base for draining oil from the apparatus during periodic maintenance of the vehicle.

In another exemplary embodiment, lower openings disposed in a sidewall of the central tube provide fluid communication between the lower chamber and an interior of the central tube; wherein upper openings disposed in the sidewall of the central tube provide fluid communication between the upper chamber and the interior of the central tube. In another exemplary embodiment, the interior of the central tube provides fluid communication between the upper chamber and the lower chamber. In another exemplary embodiment, one or more vanes are disposed in the interior of the central tube to inhibit oil flow from the lower chamber to the upper chamber.

In another exemplary embodiment, a baffled plate is disposed in the upper chamber to inhibit oil flow from the bottom to the top of the upper chamber during a tip-over of the vehicle.

In another exemplary embodiment, the upper chamber is housed within an upper canister and the lower chamber is housed within a lower canister. In another exemplary embodiment, the upper canister and the lower canister are respectively joined together by an upper flange and a lower flange.

In another exemplary embodiment, the inlet hose connector is configured to be coupled with a hose for delivering low-temperature oil from an oil cooler. In another exemplary embodiment, the outlet hose connector is configured to be coupled with a hose for routing the low-temperature oil to the engine. In another exemplary embodiment, the bypass hose connector is configured to be coupled with a hose for routing the low-temperature oil to the engine during a tip-over of the vehicle.

In an exemplary embodiment, a method is disclosed for lubricating the engine of the off-road vehicle, the method includes forming an upper chamber and a lower chamber disposed on opposite sides of an intervening separator; establishing fluid communication between the lower chamber and the upper chamber by way of a central tube; configuring an inlet hose connector for supplying engine oil to the lower chamber; configuring an outlet hose connector for conducting the engine oil from the lower chamber to an engine; and configuring a bypass hose connector for allowing the engine oil to exit the upper chamber to the engine.

In another exemplary embodiment, establishing fluid communication includes forming lower openings in a sidewall of the central tube to provide fluid communication between the lower chamber and an interior of the central tube; and forming upper openings in the sidewall of the central tube to provide fluid communication between the upper chamber and the interior of the central tube. In another exemplary embodiment, establishing fluid communication includes arranging one or more vanes in the interior of the central tube to inhibit oil flow from the lower chamber to the upper chamber. In another exemplary embodiment, arranging includes angling one or more vanes toward the lower chamber.

In an exemplary embodiment, a method for using the disclosed apparatus comprises mounting an upper chamber within an engine bay of a vehicle; mounting a lower chamber below the upper chamber; coupling an inlet hose connector with a hose for supplying low-temperature oil from an oil cooler; coupling an outlet hose connector with a hose for routing the low-temperature oil to the engine; coupling a bypass hose connector with a hose for routing the low-temperature oil to the engine during a tip-over of the vehicle.

In another exemplary embodiment, the method further comprises opening a fill cap and adding engine oil into the upper chamber and the lower chamber. In another exemplary embodiment, adding engine oil includes threading and tightening a drain plug into the base of the lower chamber.

These and other features of the concepts provided herein may be better understood with reference to the drawings, description, and appended claims

BRIEF DESCRIPTION OF THE DRAWINGS

The accompanying figures, which are incorporated herein, form part of the specification and illustrate embodiments of the present invention. Together with the description, the figures further explain the principles of the present invention and enable a person skilled in the relevant arts to make and use the invention.

FIG. 1 illustrates an exemplary embodiment of an off-road vehicle.

FIG. 2 illustrates a block diagram illustrating the oil flow between the engine cooler, disclosed apparatus, and the engine, according to an exemplary embodiment of the present invention.

Figure 3:
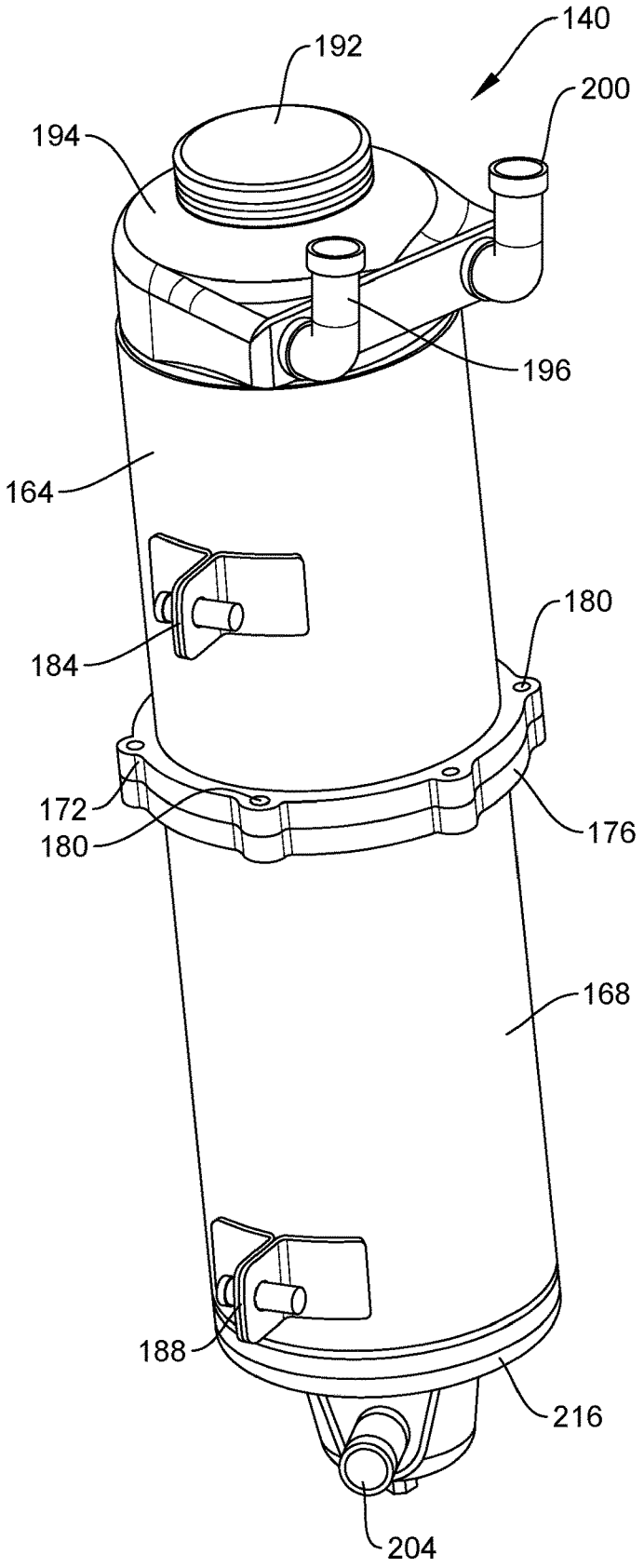
FIG. 3 illustrates an isometric view of an exemplary embodiment of the apparatus, according to the present disclosure.

While the present disclosure is subject to various modifications and alternative forms, specific embodiments thereof have been shown by way of example in the drawings and will herein be described in detail. The present disclosure should be understood to not be limited to the particular forms disclosed, but on the contrary, the intention is to cover all modifications, equivalents, and alternatives falling within the spirit and scope of the present disclosure.

DETAILED DESCRIPTION

Subject matter will now be described more fully hereinafter with reference to the accompanying drawings, which form a part hereof, and which show, by way of illustration, specific exemplary embodiments. Subject matter may, however, be embodied in a variety of different forms and, therefore, covered or claimed subject matter is intended to be construed as not being limited to any exemplary embodiments set forth herein; exemplary embodiments are provided merely to be illustrative. Likewise, the reasonably broad scope for claimed or covered subject matter is intended. Among other things, for example, the subject matter may be embodied as methods, devices, components, or systems. The following detailed description is, therefore, not intended to be taken in a limiting sense.

The word "exemplary" is used herein to mean "serving as an example, instance, or illustration." Any embodiment described herein as "exemplary" is not necessarily to be construed as preferred or advantageous over other embodiments. Likewise, the term "embodiments of the present invention" does not require that all embodiments of the invention include the discussed feature, advantage, or mode of operation.

The terminology used herein is to describe particular embodiments only and is not intended to be limiting of embodiments of the invention. As used herein, the singular forms "a", "an", and "the" are intended to include the plural forms as well, unless the context indicates otherwise. It will be further understood that the terms "comprises", "comprising,", "includes" and/or "including", when used herein, specify the presence of stated features, integers, steps, operations, elements, and/or components, but do not preclude the presence or addition of one or more other features, integers, steps, operations, elements, components, and/or groups thereof.

The following detailed description includes the best currently contemplated mode or modes of carrying out exemplary embodiments of the invention. The description is not to be taken in a limiting sense but is made merely to illustrate the general principles of the invention since the scope of the invention will be best defined by the allowed claims of any resulting patent.

In the following description, numerous specific details are set forth to provide a thorough understanding of the present disclosure. It will be apparent, however, to one of the ordinary skills in the art that the apparatus and methods disclosed herein may be practiced without these specific details.

In other instances, specific numeric references such as "first tube," may be made. However, the specific numeric reference should not be interpreted as a literal sequential order but rather interpreted that the "first tube" is different than a "second tube." Thus, the specific details set forth are merely exemplary. The specific details may be varied from and still be contemplated to be within the spirit and scope of the present disclosure. The term "coupled" is defined as meaning connected either directly to the component or indirectly to the component through another component.

Further, as used herein, the terms "about," "approximately," or "substantially" for any numerical values or ranges indicate a suitable dimensional tolerance that allows the part or collection of components to function for its intended purpose as described herein.

Off-road vehicles enjoy an enthusiastic following because of their many uses and versatility, such as competitions and racing over various types of terrain. During such competitions, off-road vehicles routinely perform stunts and become airborne due to speeding over terrain features. A difficulty often encountered during racing off-road vehicles is that engines can become oil starved during jumping or tip-over events. When an off-road vehicle is airborne or upside down, engine oil no longer remains pooled at the bottom of an oil sump, causing the engine to be left running, often at high rpm, without sufficient lubrication to prevent damage to the engine.

Given that running an engine without oil, even momentarily at low speeds, can cause severe engine damage and lead to costly, time-consuming repairs, thus, disclosed is an apparatus for lubricating the engine of off-road vehicles. The disclosed apparatus can keep the oil supply to the engine during airborne maneuvers and tip-over events, thus preventing engine oil starvation. The disclosed apparatus may ensure sufficient lubrication in various components of the engine during a bumpy ride where conventional oil supply systems fail.

FIG. 1 illustrates an exemplary embodiment of an off-road vehicle 100 that is particularly suitable for the implementation of the disclosed apparatus for lubricating the engine. The off-road vehicle 100 generally is of a Utility Task Vehicle (UTV) variety that seats up to four occupants, includes a roll-over protection system 104, and may have a cab enclosure 108. It is understood that any type of off-road vehicle with varying occupancy, and with or without roll-over protection, is within the scope of the present invention.

FIG. 2 is a block diagram 136 that illustrates the flow of oil between an engine oil cooler 114, an engine 132, and the disclosed apparatus 140. The engine oil cooler 114, the engine 132, and the disclosed apparatus 140 can be connected through suitable conduits, such as hoses. FIG. 2 shows a hose 148 between engine 132 and the engine oil cooler 144, a hose 152 between the engine oil cooler 144 and the disclosed apparatus 140, and a hose 156 between the disclosed apparatus 140 and engine 132. The engine oil cooler can be any engine oil cooler known in the art for use in off-road vehicles. As will be appreciated, the engine oil cooler 144 is configured to remove heat from engine oil passing therethrough. In certain implementations, the engine oil cooler 144 may be air-cooled that uses fans to blow air through a heat exchanger drawing heat from oil flowing through the heat exchanger. The hose 148 conducts hot engine oil from engine 132 to engine oil cooler 144.

The oil passed through the engine oil cooler 144, gets cooled, and the low-temperature oil is directed through the hose 152 from the oil cooler 144 to the disclosed apparatus 140. Hose 156 then directs the low-temperature oil from the disclosed apparatus 140 to engine 132 for lubricating the engine.

In general, the disclosed apparatus 140 holds a volume of oil that is suitable for maintaining lubrication to engine 132 when vehicle 100 is airborne or upside down due to tipping over. As further shown in FIG. 2, hose 160 is disposed at the top of apparatus 140 and routed to engine 132. In some implementations, hose 160 operates as an oil bypass line that allows excess engine oil to exit apparatus 140 and return directly to engine 132.

It is contemplated that in such implementations, hose 160 can be used to maintain a suitable pressure within apparatus 140. It is further contemplated that, in some embodiments, hose 160 serves to direct low-temperature oil from apparatus 140 to engine 132 when vehicle 100, and thus the apparatus is upside down due to a tip-over event.

Turning now, to FIG. 3, an isometric view of an exemplary embodiment of apparatus 140 is shown according to the present disclosure. The apparatus 140 generally is cylindrical and comprises an upper canister 164 and a lower canister 168 that are respectively joined together by an upper flange 172 and a lower flange 176. Multiple fasteners 180 are arranged about a circumference of the upper 172 and lower flanges 176 to enable coupling the upper canister 164 and the lower canister 168 together. As will be appreciated, a suitable gasket may be disposed between the upper flange 172 and the lower flange 176 to form an oil-tight seal between the upper canister 164 and the lower canister 168. The fasteners 180 may comprise any of the various fasteners that are suitable for joining the upper canister 164 and the lower canister 168, without limitation.

As further shown in FIG. 3, an upper bracket 184 is disposed on the upper canister 164, and a lower bracket 188 is disposed on the lower canister 168. The upper bracket 184 and lower bracket 188 generally are configured to enable mounting the disclosed apparatus 140 within an engine bay of vehicle 100. It is understood, however, that the disclosed apparatus can be mounted elsewhere without departing from the scope of the present invention. The apparatus 140 preferably is mounted within the engine bay in an upright orientation, as shown in FIG. 3, such that a fill cap 192 and a fill chamber 194 are disposed atop the upper canister 164. It is contemplated that fill cap 192 may be unscrewed and the fill chamber 194 may be used to add engine oil to the apparatus 140, and thus to the engine 132, as well as to remove unwanted air that may be trapped within the apparatus 140.

Furthermore, a drain plug 198 is threaded into a base disposed at the bottom of the lower canister 168. It is contemplated that drain plug 198 may be removed from base 216 to drain oil from the oil apparatus 140 during periodic maintenance of vehicle 100, such as for an oil change.

With continuing reference to FIG. 3, the engine oil starvation preventer 140 includes an inlet hose connector 196 and a bypass hose connector 200 disposed atop the upper canister 164 and an outlet hose connector 204 coupled with the base 216 disposed at the bottom of the lower canister 168. The inlet hose connector 196 is configured to be coupled with hose 152, as shown in FIG. 2, and thus receives low-temperature oil from the oil cooler 144 into apparatus 140. The bypass hose connector 200 is configured to be coupled with hose 160 to direct excess oil from apparatus 140 to engine 132, as described herein.

The outlet hose connector 204 is configured to be coupled with hose 156, as shown in FIG. 2, for routing low-temperature oil to engine 132.

Figure 4:
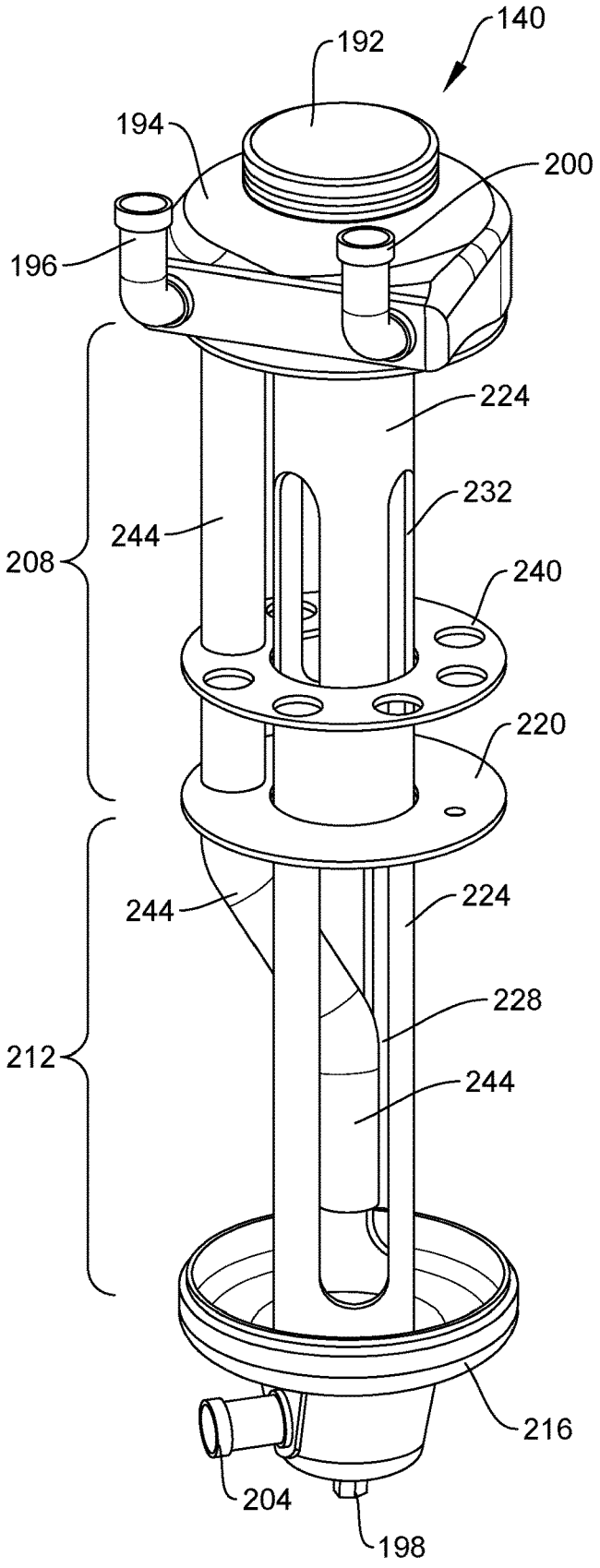
FIG. 4 illustrates the apparatus without its exterior canister to show the interior of the apparatus, in accordance with the present disclosure.

Turning, now, to FIG. 4, apparatus 140 is shown in the absence of the upper canister 164 and the lower canister 168. As will be recognized, the upper canister 164 generally houses an upper chamber 208 within apparatus 140, and the lower canister 168 houses a lower chamber 212 within apparatus 140. A separator 220 forms a partition between upper chamber 208 and the lower chamber 212.

Furthermore, a central tube 224 extends from the base 216, through the separator 220, to the fill chamber 194 atop the apparatus 140. Lower openings 228 disposed in the sidewall of central tube 224 provide fluid communication between the lower chamber 212 and the interior of the central tube 224.

Similarly, upper openings 232 disposed in the sidewall of the central tube 224 provide fluid communication between the upper chamber 208 and the interior of the central tube 224. As such, the interior of the central tube 224 provides fluid communication between the upper chamber 208 and lower chamber 212 of apparatus 140.

Figure 5:
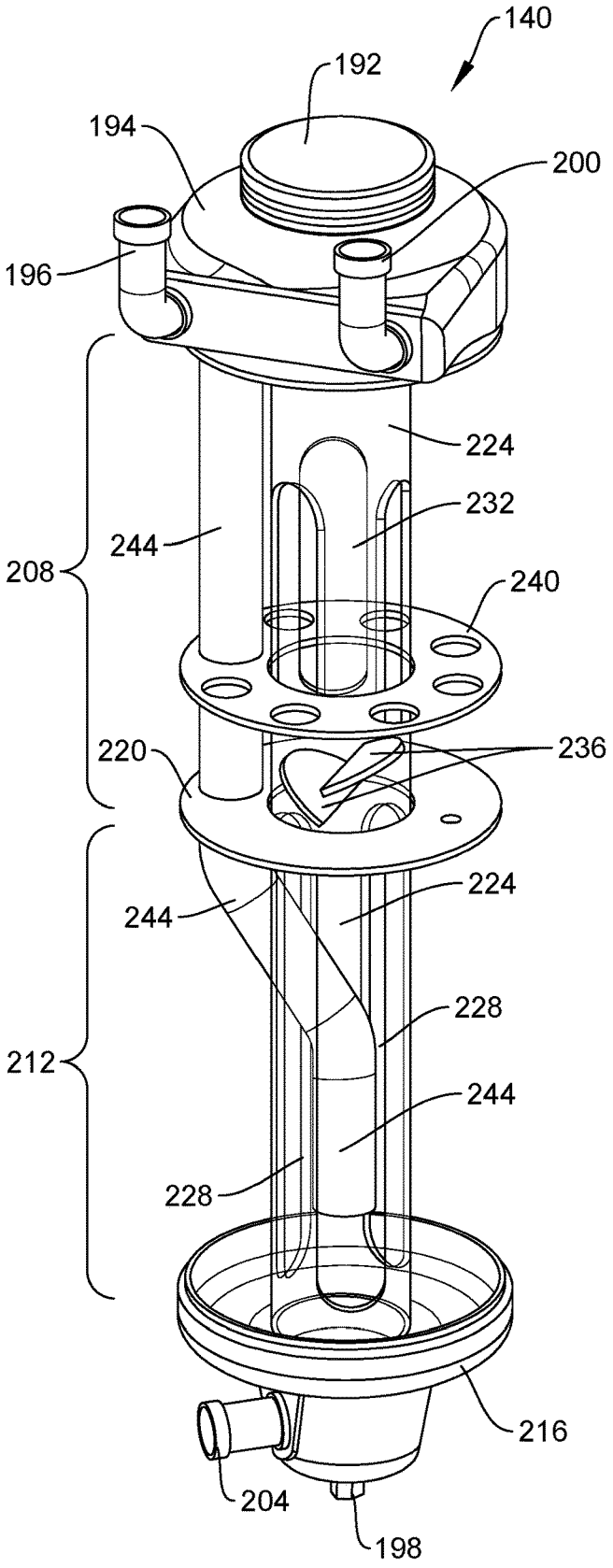
FIG. 5 illustrates a partial ghost view of the apparatus that shows vanes for controlling oil movement within a central tube of the apparatus, according to an exemplary embodiment of the present disclosure.

It should be borne in mind that while fluid communication between the upper chamber 208 and the lower chamber 212 allows for filling and draining oil from the apparatus 140, as well as allowing for oil to exit through the bypass hose connector 200 when needed, oil should remain pooled in the lower chamber 212 when the vehicle is airborne or upside down due to a tip-over. As such, the flow of oil from lower chamber 212 to upper chamber 208 generally is inhibited. For example, as best shown in FIG. 5, one or more vanes 236 are disposed in the interior of the central tube 224. Thus, the oil must flow around the vanes 236 as it moves through the central tube 224, thereby limiting the flow rate out of the lower chamber 212. As shown in FIG. 5, vanes 236 may be angled toward the lower chamber 212 to further inhibit the flow of oil from the lower chamber to the upper chamber. Furthermore, a baffled plate 240 may be disposed in the upper chamber 208 to inhibit oil flow from the bottom to the top of the upper chamber 208 during a tip-over of vehicle 100 or when the vehicle is airborne. It is to be noted that the vanes can be replaced by any other method to prevent the backflow of oil, and such a means or method is within the scope of the present invention.

With continuing reference to FIGS. 4-5, oil flow from the lower chamber 212 to the upper chamber 208 is further inhibited by the presence of an oil inlet tube 244 disposed in the interior of the central tube 224. The oil inlet tube 244 extends upward, out of the central tube 224 into the lower chamber 212, and then passes through the separator 220. After passing through separator 220, the oil inlet tube 244 extends upward through the upper chamber 208 and into the fill chamber 194 before coupling with the inlet hose connector 196. As such, low-temperature oil entering the inlet hose connector 196, by way of the hose 152 (see FIG. 2), is conducted by the oil inlet tube 244 into the interior of the central tube 224 and the lower chamber 212. The low-temperature oil is then withdrawn from the interior of the central tube 224 and the lower chamber 212 through the outlet hose connector 204 and routed to the engine 132 by way of the hose 156, as described herein.

It is contemplated that the presence of the oil inlet tube 244 within the interior of the central tube 224 as well as inflowing oil from the oil inlet tube 244 serve to effectively hinder a migration of oil from the lower chamber 212 into the upper chamber 208 when the vehicle 100 is airborne or upside down due to tipping over.

Moreover, in some embodiments, hose 160 may be used to direct low-temperature oil from apparatus 140 to engine 132 when vehicle 100 is upside down due to a tip-over event. For example, when vehicle 100 is upside down, and low-temperature oil migrates from the lower chamber 212 into the upper chamber 208, the oil in the upper chamber 208 may be drawn into engine 132. As such, switching from lower chamber 212 to the upper chamber 208 maintains lubrication of engine 132, thereby preventing oil starvation of engine 132, while vehicle 100 is upside down.

While the engine oil starvation preventer and methods have been described in terms of particular variations and illustrative figures, those of ordinary skill in the art will recognize that the engine oil starvation preventer is not limited to the variations or figures described. In addition, where methods and steps described above indicate certain events occurring in a certain order, those of ordinary skill in the art will recognize that the ordering of certain steps may be modified and that such modifications are in accordance with the variations of the engine oil starvation preventer.

Additionally, certain of the steps may be performed concurrently in a parallel process, when possible, as well as performed sequentially as described above. To the extent there are variations of the engine oil starvation preventer, which are within the spirit of the disclosure or equivalent to the engine oil starvation preventer found in the claims, it is the intent that this patent will cover those variations as well. Therefore, the present disclosure is to be understood as not limited by the specific embodiments described herein, but only by the scope of the appended claims.

What is claimed is:

1. An apparatus for lubricating an engine of an off-road vehicle, the apparatus comprising:

an upper chamber and a lower chamber;

a separator disposed between the upper chamber and the lower chamber;

an inlet hose connector for supplying engine oil to the lower chamber;

an outlet hose connector for conducting the engine oil from the lower chamber to an engine;

a bypass hose connector for allowing engine oil to exit from the upper chamber to the engine;

a fill chamber atop the upper chamber;

a base at a bottom of the lower chamber; and a central tube extending from the base, through the separator, and opening into the fill chamber, wherein the inlet hose connector and the bypass hose connector are configured in the fill chamber.

2. The apparatus of claim 1, wherein a fill cap is disposed atop the fill chamber for adding engine oil and removing trapped air within the upper chamber.

3. The apparatus of claim 2, wherein a drain plug is threaded into a bottom of the base for draining oil.

4. The apparatus of claim 1, wherein a portion of the central tube within the lower chamber has openings in a side wall of the central tube for fluid communication between the lower chamber and an interior of the central tube; and wherein a portion of the central tube within the upper chamber has openings in the side wall for fluid communication between the upper chamber and the interior of the central tube.

5. The apparatus of claim 4, wherein the interior of the central tube provides fluid communication between the upper chamber and the lower chamber.

6. The apparatus of claim 5, wherein one or more vanes are disposed in the interior of the central tube to inhibit oil flow from the lower chamber to the upper chamber.

7. The apparatus of claim 1, wherein a baffle plate is disposed in the upper chamber to inhibit oil flow from a bottom to a top of the upper chamber during a tip-over of the off-road vehicle.

8. The apparatus of claim 1, wherein the upper chamber is housed within an upper canister and the lower chamber is housed within a lower canister.

9. The apparatus of claim 8, wherein the upper canister and the lower canister are respectively joined together by an upper flange and a lower flange.

10. The apparatus of claim 1, wherein the inlet hose connector is configured to be coupled with a hose for delivering low-temperature oil from an oil cooler.

11. The apparatus of claim 10, wherein the outlet hose connector is configured to be coupled with a hose for routing the low-temperature oil to the engine.

12. The apparatus of claim 11, wherein the bypass hose connector is configured to be coupled with a hose for routing the low-temperature oil to the engine during a tip-over of the off-road vehicle.

* * * * *